US010178489B2

(12) United States Patent
Sen et al.

(10) Patent No.: US 10,178,489 B2
(45) Date of Patent: Jan. 8, 2019

(54) SIGNALING AUDIO RENDERING INFORMATION IN A BITSTREAM

(71) Applicant: QUALCOMM Incorporated, San Diego, CA (US)

(72) Inventors: Dipanjan Sen, San Diego, CA (US); Martin James Morrell, San Diego, CA (US); Nils Günther Peters, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 37 days.

(21) Appl. No.: 14/174,769

(22) Filed: Feb. 6, 2014

(65) Prior Publication Data

US 2014/0226823 A1 Aug. 14, 2014

Related U.S. Application Data

(60) Provisional application No. 61/762,758, filed on Feb. 8, 2013.

(51) Int. Cl.
*H04S 5/00* (2006.01)
*H04S 7/00* (2006.01)
(Continued)

(52) U.S. Cl.
CPC ..... *H04S 7/30* (2013.01); *G10L 19/167* (2013.01); *H04S 7/308* (2013.01); *G10L 19/008* (2013.01);
(Continued)

(58) Field of Classification Search
CPC ... H04S 5/00; H04S 5/005; H04S 7/30; H04S 2420/11; H04S 2400/01; H04S 3/02; G10L 19/008
(Continued)

(56) References Cited

U.S. PATENT DOCUMENTS 6,931,370 B1 * 8/2005 McDowell ..... H04S 3/008 704/200.1
8,406,436 B2 3/2013 Craven et al.
(Continued)

FOREIGN PATENT DOCUMENTS

CN 101548554 A 9/2009
CN 102440002 A 5/2012
(Continued)

OTHER PUBLICATIONS

Combined PDAM Registration and PDAM Consideration Ballot on ISO/IEC 23001-8:2013/PDAM 1 [SC 29/WG 11 N 114450], ISO/IEC JTC 1/SC 29/WG11, Document N14129, Apr. 21, 2014, 20 pp.
(Continued)

*Primary Examiner* — Thomas Alunkal
(74) *Attorney, Agent, or Firm* — Shumaker & Sieffert, P.A.

(57) ABSTRACT

In general, techniques are described for specifying audio rendering information in a bitstream. A device configured to generate the bitstream may perform various aspects of the techniques. The bitstream generation device may comprise one or more processors configured to specify audio rendering information that includes a signal value identifying an audio renderer used when generating the multi-channel audio content. A device configured to render multi-channel audio content from a bitstream may also perform various aspects of the techniques. The rendering device may comprise one or more processors configured to determine audio rendering information that includes a signal value identifying an audio renderer used when generating the multi-channel audio content, and render a plurality of speaker feeds based on the audio rendering information.

34 Claims, 9 Drawing Sheets

(51) Int. Cl.
*G10L 19/16* (2013.01)
*G10L 19/008* (2013.01)

(52) U.S. Cl.
CPC ..... *H04S 7/301* (2013.01); *H04S 2420/03* (2013.01); *H04S 2420/11* (2013.01)

(58) Field of Classification Search
USPC ..... 381/17, 20, 300, 307, 80, 303, 18
See application file for complete search history.

(56) References Cited

U.S. PATENT DOCUMENTS

| | | | | |
|---|---|---|---|---|
| 9,338,574 | B2 * | 5/2016 | Jax | G10L 21/00 |
| 2011/0249821 | A1 | 10/2011 | Jaillet | |
| 2012/0093344 | A1 | 4/2012 | Sun et al. | |
| 2012/0155653 | A1 | 6/2012 | Jax et al. | |
| 2012/0259442 | A1 * | 10/2012 | Jin | H04S 7/30 700/94 |
| 2012/0314875 | A1 * | 12/2012 | Lee | G10L 19/008 381/22 |
| 2013/0064375 | A1 * | 3/2013 | Atkins | H04S 7/301 381/17 |
| 2014/0025386 | A1 * | 1/2014 | Xiang | G10L 19/00 704/500 |
| 2014/0133660 | A1 | 5/2014 | Jax et al. | |
| 2014/0133683 | A1 | 5/2014 | Robinson et al. | |
| 2015/0163615 | A1 * | 6/2015 | Boehm | H04S 3/008 381/1 |
| 2015/0213803 | A1 | 7/2015 | Peters | |
| 2015/0264484 | A1 | 9/2015 | Peters et al. | |
| 2015/0341736 | A1 | 11/2015 | Peters et al. | |

FOREIGN PATENT DOCUMENTS

| | | | | |
|---|---|---|---|---|
| EP | 2450880 | A1 * | 5/2012 | G10L 19/008 |
| EP | 2451196 | A1 | 5/2012 | |
| EP | 2946468 | A2 | 11/2015 | |
| RU | 93005794 | A | 12/1996 | |
| RU | 2439719 | C2 | 1/2012 | |
| WO | 2011039195 | A1 | 4/2011 | |
| WO | 2011073201 | A2 | 6/2011 | |
| WO | 2013006338 | A2 | 1/2013 | |
| WO | 2014012945 | A1 | 1/2014 | |
| WO | 2014111308 | A1 | 7/2014 | |
| WO | 2014194099 | A1 | 12/2014 | |

OTHER PUBLICATIONS

International Search Report and Written Opinion—PCT/US2014/015305—ISA/EPO—dated Jun. 6, 2014, 10 pp.
Painter, "Perceptual Coding of Digital Audio," Proceedings of the IEEE, vol. 8 (4), Apr. 2000, pp. 451-513.
Poletti, "Unified Description of Ambisonics Using Real and Complex Spherical Harmonics," Ambisonics Symposium Jun. 25-27, 2009, 10 pp.
Sen, et al., "Differences and Similarities in Formats for Scene Based Audio," ISO/IEC JTC1/SC29/WG11 MPEG2012/M26704, Oct. 2012, Shanghai, China, 7 pp.
U.S. Appl. No. 62/023,662 filed by Peters, et al., filed Jul. 11, 2014.
International Preliminary Report on Patentability from International Application No. PCT/US2014/015305, dated Apr. 13, 2015, 7 pp.
Ballard, et al., "Symmetric Eigenvalue Problem: Tridiagonal Reduction", Parallel Algorithms, May 18, 2009, XP055207181, 12 pp., Retrieved from the Internet: URL: http://www.eecs.berkeley.edu/~ballard/projects/CS267paper.pdf [retrieved on Aug. 11, 2015].
Boehm, "Decoding for 3D," AES Convention 130; May 13, 2011, XP040567441, 16 pp.
Boehm, et al., "HOA Decoder—changes and proposed modification," Technicolor, MPEG Meeting; Mar. 31-Apr. 4, 2014; Valencia; (Motion Picture Expert Group or ISO/IEC JTC1/SC29/WG11), No. m33196, Mar. 26, 2014; 16 pp., XP030061648.
Cuthill, et al., "Reducing the Bandwidth of Sparse Symmetric Matrices", Proceedings of the 1969 24th national conference, Jan. 1969, XP055207178, pp. 157-172.
Schonefeld, "Spherical Harmonics," Jul. 1, 2005, XP002599101, 25 pp., Accessed online [Jul. 9, 2013] at URL: http://videoarch1.s-inf.de/~volker/prosem_paper.pdf.
Sen, et al., "RM1-HOA Working Draft Text ", MPEG Meeting; Jan. 13-17, 2014; San Jose; (Motion Picture Expert Group or ISO/IEC JTC1/SC29/WG11),,No. m31827, Jan. 11, 2014, XP030060280, 83 pp.
"Call for Proposals for 3D Audio," ISO/IEC JTC1/SC29/WG11/N13411, Jan. 2013, 20 pp.
Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.
Poletti, "Three-Dimensional Surround Sound Systems Based on Spherical Harmonics," J. Audio Eng. Soc., vol. 53, No. 11, Nov. 2005 , pp. 1004-1025.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D Audio," ISO/IEC JTC 1/SC 29, Jul. 25, 2014, 311 pp.
Hollerweger, et al., "An Introduction to Higher Order Ambisonic," Oct. 2008, 13 pp.
Office Action, and a partial translation, from counterpart Israel Patent Application No. 239748, dated Feb. 1, 2018, 3 pp.
Response to Russian Office Action dated Jan. 23, 2018, from counterpart Russian Patent Application No. 2015138139, filed on Apr. 23, 2018, 4 pp.

* cited by examiner

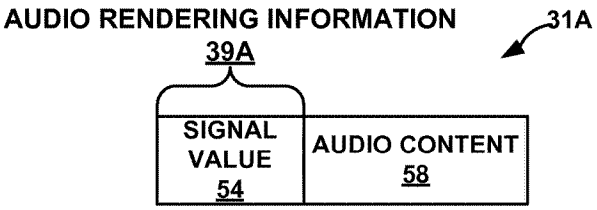
FIG. 8A
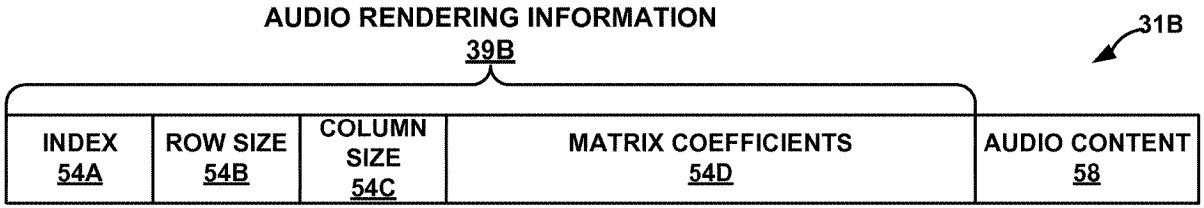
FIG. 8B
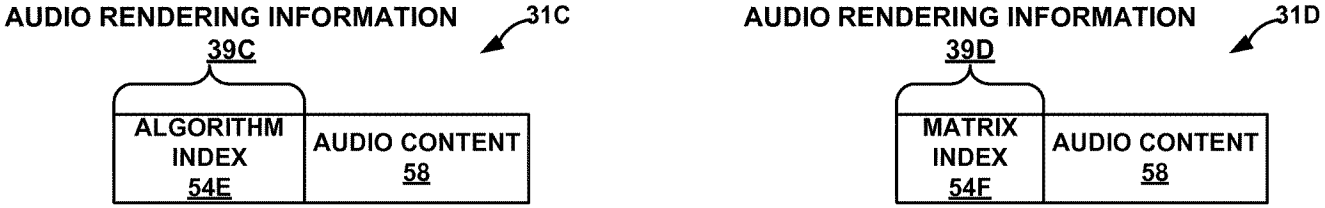
FIG. 8C
FIG. 8D

SIGNALING AUDIO RENDERING INFORMATION IN A BITSTREAM

This application claims the benefit of U.S. Provisional Application No. 61/762,758, filed Feb. 8, 2013.

TECHNICAL FIELD

This disclosure relates to audio coding and, more specifically, bitstreams that specify coded audio data.

BACKGROUND

During production of audio content, the sound engineer may render the audio content using a specific renderer in an attempt to tailor the audio content for target configurations of speakers used to reproduce the audio content. In other words, the sound engineer may render the audio content and playback the rendered audio content using speakers arranged in the targeted configuration. The sound engineer may then remix various aspects of the audio content, render the remixed audio content and again playback the rendered, remixed audio content using the speakers arranged in the targeted configuration. The sound engineer may iterate in this manner until a certain artistic intent is provided by the audio content. In this way, the sound engineer may produce audio content that provides a certain artistic intent or that otherwise provides a certain sound field during playback (e.g., to accompany video content played along with the audio content).

SUMMARY

In general, techniques are described for specifying audio rendering information in a bitstream representative of audio data. In other words, the techniques may provide for a way by which to signal audio rendering information used during audio content production to a playback device, which may then use the audio rendering information to render the audio content. Providing the rendering information in this manner enables the playback device to render the audio content in a manner intended by the sound engineer, and thereby potentially ensure appropriate playback of the audio content such that the artistic intent is potentially understood by a listener. In other words, the rendering information used during rendering by the sound engineer is provided in accordance with the techniques described in this disclosure so that the audio playback device may utilize the rendering information to render the audio content in a manner intended by the sound engineer, thereby ensuring a more consistent experience during both production and playback of the audio content in comparison to systems that do not provide this audio rendering information.

In one aspect, a method of generating a bitstream representative of multi-channel audio content, the method comprises specifying audio rendering information that includes a signal value identifying an audio renderer used when generating the multi-channel audio content.

In another aspect, a device configured to generate a bitstream representative of multi-channel audio content, the device comprises one or more processors configured to specify audio rendering information that includes a signal value identifying an audio renderer used when generating the multi-channel audio content.

In another aspect, a device configured to generate a bitstream representative of multi-channel audio content, the device comprising means for specifying audio rendering information that includes a signal value identifying an audio renderer used when generating the multi-channel audio content, and means for storing the audio rendering information.

In another aspect, a non-transitory computer-readable storage medium has stored thereon instruction that when executed cause the one or more processors to specifying audio rendering information that includes a signal value identifying an audio renderer used when generating multi-channel audio content.

In another aspect, a method of rendering multi-channel audio content from a bitstream, the method comprises determining audio rendering information that includes a signal value identifying an audio renderer used when generating the multi-channel audio content, and rendering a plurality of speaker feeds based on the audio rendering information.

In another aspect, a device configured to render multi-channel audio content from a bitstream, the device comprises one or more processors configured to determine audio rendering information that includes a signal value identifying an audio renderer used when generating the multi-channel audio content, and render a plurality of speaker feeds based on the audio rendering information.

In another aspect, a device configured to render multi-channel audio content from a bitstream, the device comprises means for determining audio rendering information that includes a signal value identifying an audio renderer used when generating the multi-channel audio content, and means for rendering a plurality of speaker feeds based on the audio rendering information.

In another aspect, a non-transitory computer-readable storage medium has stored thereon instruction that when executed cause the one or more processors to determine audio rendering information that includes a signal value identifying an audio renderer used when generating multi-channel audio content, and rendering a plurality of speaker feeds based on the audio rendering information.

The details of one or more aspects of the techniques are set forth in the accompanying drawings and the description below. Other features, objects, and advantages of these techniques will be apparent from the description and drawings, and from the claims.

BRIEF DESCRIPTION OF THE DRAWINGS

FIGS. 8A-8D are diagram illustrating bitstreams 31A-31D formed in accordance with the techniques described in this disclosure.

DETAILED DESCRIPTION

Figure 1:
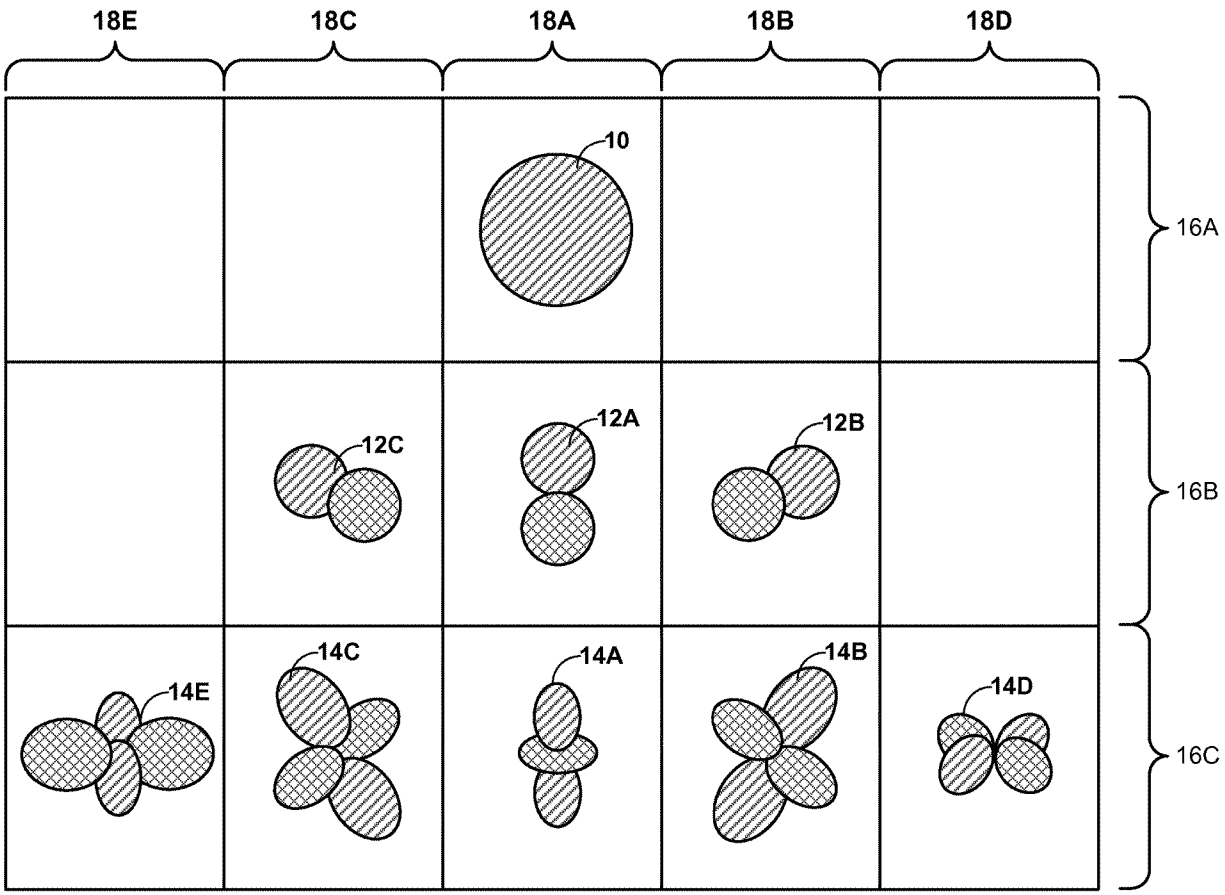
FIGS. 1-3 are diagrams illustrating spherical harmonic basis functions of various orders and sub-orders.

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the upcoming 22.2 format (e.g., for use with the Ultra High Definition Television standard). Further examples include formats for a spherical harmonic array.

The input to the future MPEG encoder is optionally one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using coefficients of spherical harmonic basis functions (also called "spherical harmonic coefficients" or SHC).

There are various 'surround-sound' formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, standard committees have been considering ways in which to provide an encoding into a standardized bitstream and a subsequent decoding that is adaptable and agnostic to the speaker geometry and acoustic conditions at the location of the renderer.

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed.

One example of a hierarchical set of elements is a set of spherical harmonic coefficients (SHC). The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r, \theta_r, \varphi_r\}$ of the sound field can be represented uniquely by the SHC $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating a zero-order spherical harmonic basis function 10, first-order spherical harmonic basis functions 12A-12C and second-order spherical harmonic basis functions 14A-14E. The order is identified by the rows of the table, which are denoted as rows 16A-16C, with row 16A referring to the zero order, row 16B referring to the first order and row 16C referring to the second order. The sub-order is identified by the columns of the table, which are denoted as columns 18A-18E, with column 18A referring to the zero suborder, column 18B referring to the first suborder, column 18C referring to the negative first suborder, column 18D referring to the second suborder and column 18E referring to the negative second suborder. The SHC corresponding to zero-order spherical harmonic basis function 10 may be considered as specifying the energy of the sound field, while the SHCs corresponding to the remaining higher-order spherical harmonic basis functions (e.g., spherical harmonic basis functions 12A-12C and 14A-14E) may specify the direction of that energy.

Figure 2:
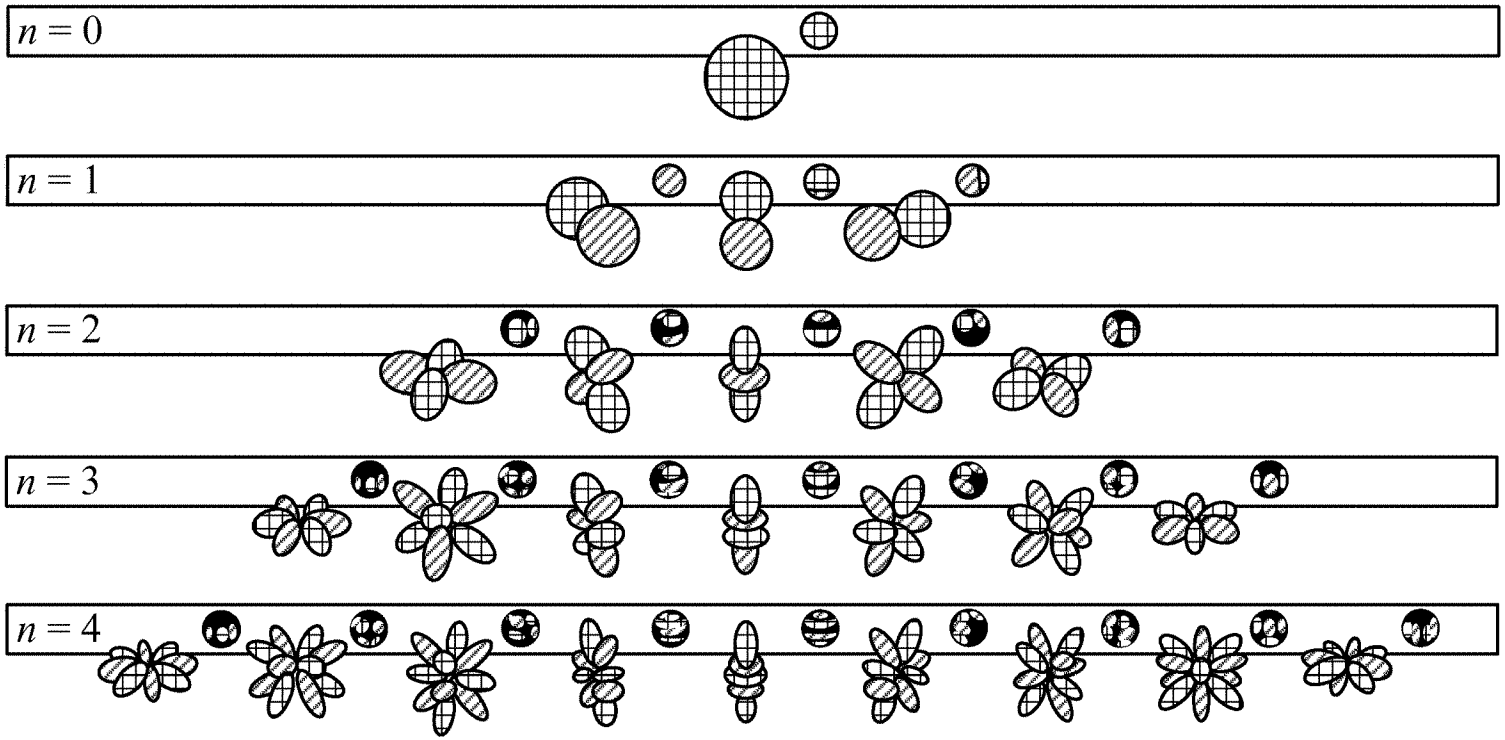

FIG. 2 is a diagram illustrating spherical harmonic basis functions from the zero order (n=0) to the fourth order (n=4). As can be seen, for each order, there is an expansion of suborders m which are shown but not explicitly noted in the example of FIG. 2 for ease of illustration purposes.

Figure 3:
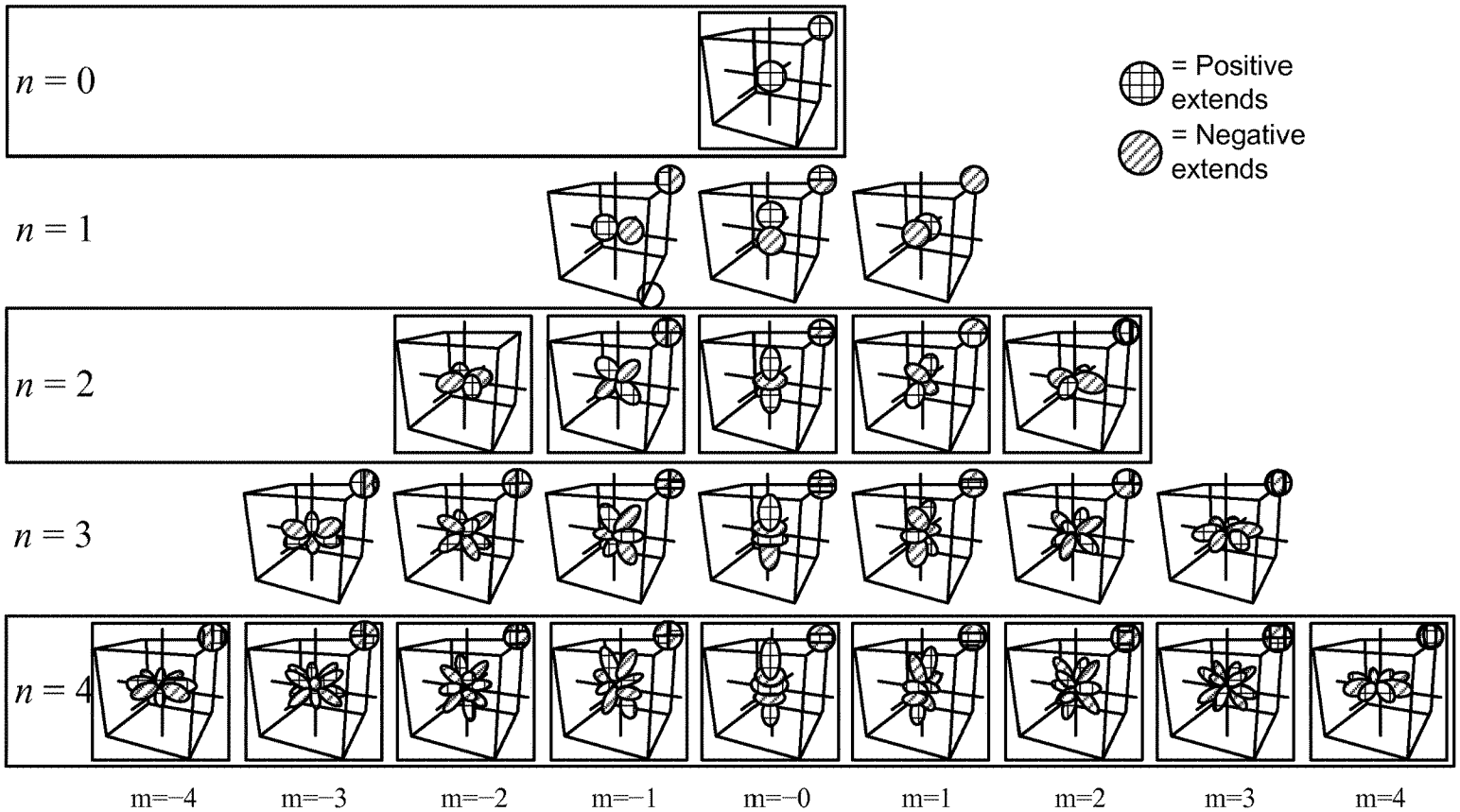

FIG. 3 is another diagram illustrating spherical harmonic basis functions from the zero order (n=0) to the fourth order (n=4). In FIG. 3, the spherical harmonic basis functions are shown in three-dimensional coordinate space with both the order and the suborder shown.

In any event, the SHC $A_n^m(k)$ can either be physically acquired (e.g., recorded) by various microphone array configurations or, alternatively, they can be derived from channel-based or object-based descriptions of the sound field. The former represents scene-based audio input to an encoder. For example, a fourth-order representation involving $1+2^4$ (25, and hence fourth order) coefficients may be used.

To illustrate how these SHCs may be derived from an object-based description, consider the following equation. The coefficients $A_n^m(k)$ for the sound field corresponding to an individual audio object may be expressed as $$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s, \theta_s, \varphi_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r, \theta_r, \varphi_r\}$. The remaining figures are described below in the context of object-based and SHC-based audio coding.

Figure 4:
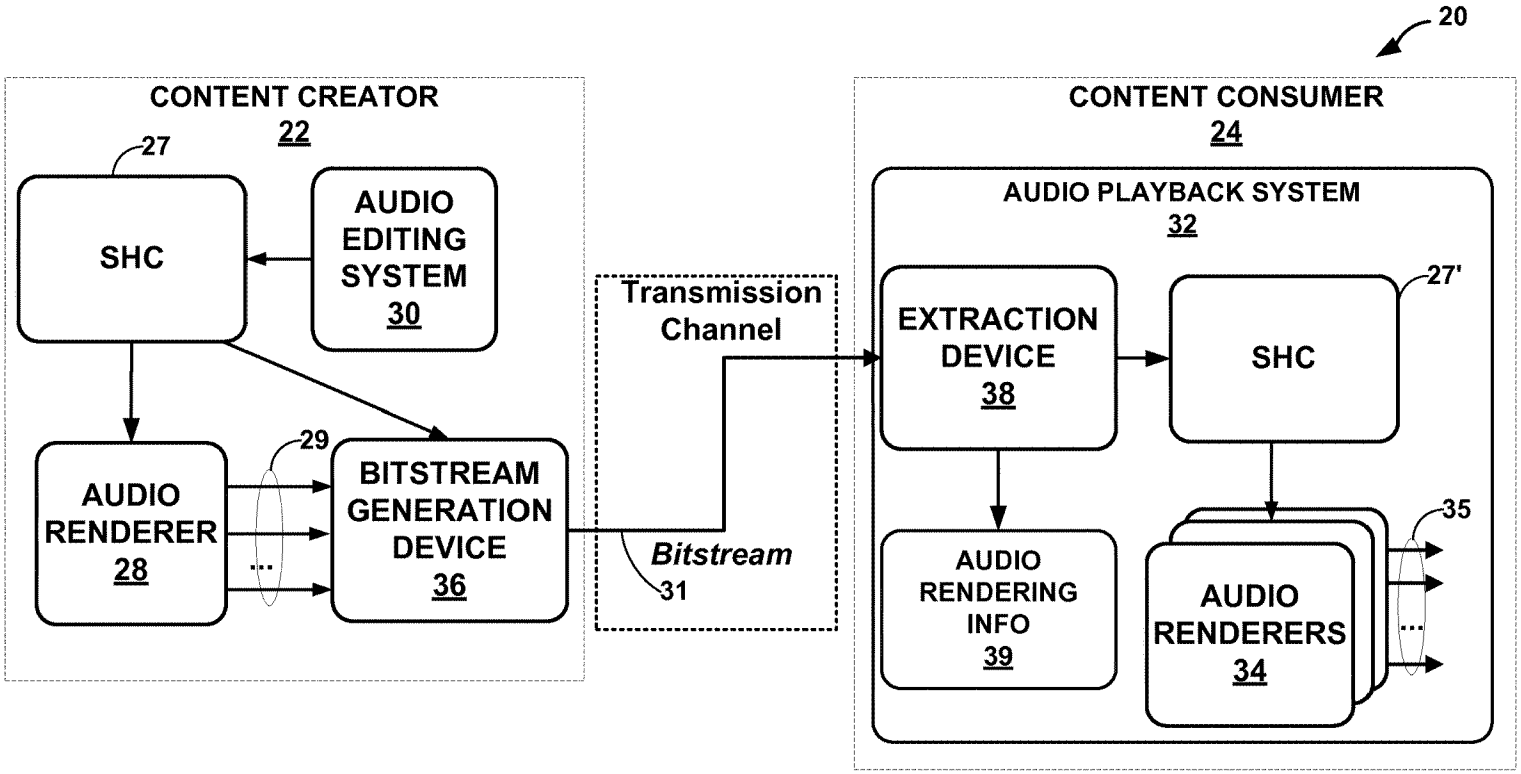
FIG. 4 is a diagram illustrating a system that may implement various aspects of the techniques described in this disclosure.

FIG. 4 is a block diagram illustrating a system 20 that may perform the techniques described in this disclosure to signal rendering information in a bitstream representative of audio data. As shown in the example of FIG. 4, system 20 includes a content creator 22 and a content consumer 24. The content creator 22 may represent a movie studio or other entity that may generate multi-channel audio content for consumption by content consumers, such as the content consumer 24. Often, this content creator generates audio content in conjunction with video content. The content consumer 24 represents an individual that owns or has access to an audio playback system 32, which may refer to any form of audio playback system capable of playing back multi-channel audio content. In the example of FIG. 4, the content consumer 24 includes the audio playback system 32.

The content creator 22 includes an audio renderer 28 and an audio editing system 30. The audio renderer 26 may represent an audio processing unit that renders or otherwise generates speaker feeds (which may also be referred to as "loudspeaker feeds," "speaker signals," or "loudspeaker signals"). Each speaker feed may correspond to a speaker feed that reproduces sound for a particular channel of a multi-channel audio system. In the example of FIG. 4, the renderer 38 may render speaker feeds for conventional 5.1, 7.1 or 22.2 surround sound formats, generating a speaker feed for each of the 5, 7 or 22 speakers in the 5.1, 7.1 or 22.2 surround sound speaker systems. Alternatively, the renderer 28 may be configured to render speaker feeds from source spherical harmonic coefficients for any speaker configuration having any number of speakers, given the properties of source spherical harmonic coefficients discussed above. The renderer 28 may, in this manner, generate a number of speaker feeds, which are denoted in FIG. 4 as speaker feeds 29.

The content creator 22 may, during the editing process, render spherical harmonic coefficients 27 ("SHC 27") to generate speaker feeds, listening to the speaker feeds in an attempt to identify aspects of the sound field that do not have high fidelity or that do not provide a convincing surround sound experience. The content creator 22 may then edit source spherical harmonic coefficients (often indirectly through manipulation of different objects from which the source spherical harmonic coefficients may be derived in the manner described above). The content creator 22 may employ an audio editing system 30 to edit the spherical harmonic coefficients 27. The audio editing system 30 represents any system capable of editing audio data and outputting this audio data as one or more source spherical harmonic coefficients.

When the editing process is complete, the content creator 22 may generate the bitstream 31 based on the spherical harmonic coefficients 27. That is, the content creator 22 includes a bitstream generation device 36, which may represent any device capable of generating the bitstream 31. In some instances, the bitstream generation device 36 may represent an encoder that bandwidth compresses (through, as one example, entropy encoding) the spherical harmonic coefficients 27 and that arranges the entropy encoded version of the spherical harmonic coefficients 27 in an accepted format to form the bitstream 31. In other instances, the bitstream generation device 36 may represent an audio encoder (possibly, one that complies with a known audio coding standard, such as MPEG surround, or a derivative thereof) that encodes the multi-channel audio content 29 using, as one example, processes similar to those of conventional audio surround sound encoding processes to compress the multi-channel audio content or derivatives thereof. The compressed multi-channel audio content 29 may then be entropy encoded or coded in some other way to bandwidth compress the content 29 and arranged in accordance with an agreed upon format to form the bitstream 31. Whether directly compressed to form the bitstream 31 or rendered and then compressed to form the bitstream 31, the content creator 22 may transmit the bitstream 31 to the content consumer 24.

While shown in FIG. 4 as being directly transmitted to the content consumer 24, the content creator 22 may output the bitstream 31 to an intermediate device positioned between the content creator 22 and the content consumer 24. This intermediate device may store the bitstream 31 for later delivery to the content consumer 24, which may request this bitstream. The intermediate device may comprise a file server, a web server, a desktop computer, a laptop computer, a tablet computer, a mobile phone, a smart phone, or any other device capable of storing the bitstream 31 for later retrieval by an audio decoder. Alternatively, the content creator 22 may store the bitstream 31 to a storage medium, such as a compact disc, a digital video disc, a high definition video disc or other storage mediums, most of which are capable of being read by a computer and therefore may be referred to as computer-readable storage mediums. In this context, the transmission channel may refer to those channels by which content stored to these mediums are transmitted (and may include retail stores and other store-based delivery mechanism). In any event, the techniques of this disclosure should not therefore be limited in this respect to the example of FIG. 4.

As further shown in the example of FIG. 4, the content consumer 24 includes an audio playback system 32. The audio playback system 32 may represent any audio playback system capable of playing back multi-channel audio data. The audio playback system 32 may include a number of different renderers 34. The renderers 34 may each provide for a different form of rendering, where the different forms of rendering may include one or more of the various ways of performing vector-base amplitude panning (VBAP), one or more of the various ways of performing distance based amplitude panning (DBAP), one or more of the various ways of performing simple panning, one or more of the various ways of performing near field compensation (NFC) filtering and/or one or more of the various ways of performing wave field synthesis.

The audio playback system 32 may further include an extraction device 38. The extraction device 38 may represent any device capable of extracting the spherical harmonic coefficients 27' ("SHC 27'," which may represent a modified form of or a duplicate of the spherical harmonic coefficients 27) through a process that may generally be reciprocal to that of the bitstream generation device 36. In any event, the audio playback system 32 may receive the spherical harmonic coefficients 27'. The audio playback system 32 may then select one of renderers 34, which then renders the spherical harmonic coefficients 27' to generate a number of speaker feeds 35 (corresponding to the number of loudspeakers electrically or possibly wirelessly coupled to the audio playback system 32, which are not shown in the example of FIG. 4 for ease of illustration purposes).

Typically, the audio playback system 32 may select any one the of audio renderers 34 and may be configured to select the one or more of audio renderers 34 depending on the source from which the bitstream 31 is received (such as a DVD player, a Blu-ray player, a smartphone, a tablet computer, a gaming system, and a television to provide a few examples). While any one of the audio renderers 34 may be selected, often the audio renderer used when creating the content provides for a better (and possibly the best) form of rendering due to the fact that the content was created by the content creator 22 using this one of audio renderers, i.e., the audio renderer 28 in the example of FIG. 4. Selecting the one of the audio renderers 34 that is the same or at least close (in terms of rendering form) may provide for a better representation of the sound field and may result in a better surround sound experience for the content consumer 24.

In accordance with the techniques described in this disclosure, the bitstream generation device 36 may generate the bitstream 31 to include the audio rendering information 39 ("audio rendering info 39"). The audio rendering information 39 may include a signal value identifying an audio renderer used when generating the multi-channel audio content, i.e., the audio renderer 28 in the example of FIG. 4. In some instances, the signal value includes a matrix used to render spherical harmonic coefficients to a plurality of speaker feeds.

In some instances, the signal value includes two or more bits that define an index that indicates that the bitstream includes a matrix used to render spherical harmonic coefficients to a plurality of speaker feeds. In some instances, when an index is used, the signal value further includes two or more bits that define a number of rows of the matrix included in the bitstream and two or more bits that define a number of columns of the matrix included in the bitstream. Using this information and given that each coefficient of the two-dimensional matrix is typically defined by a 32-bit floating point number, the size in terms of bits of the matrix may be computed as a function of the number of rows, the number of columns, and the size of the floating point numbers defining each coefficient of the matrix, i.e., 32-bits in this example.

In some instances, the signal value specifies a rendering algorithm used to render spherical harmonic coefficients to a plurality of speaker feeds. The rendering algorithm may include a matrix that is known to both the bitstream generation device 36 and the extraction device 38. That is, the rendering algorithm may include application of a matrix in addition to other rendering steps, such as panning (e.g., VBAP, DBAP or simple panning) or NFC filtering. In some instances, the signal value includes two or more bits that define an index associated with one of a plurality of matrices used to render spherical harmonic coefficients to a plurality of speaker feeds. Again, both the bitstream generation device 36 and the extraction device 38 may be configured with information indicating the plurality of matrices and the order of the plurality of matrices such that the index may uniquely identify a particular one of the plurality of matrices. Alternatively, the bitstream generation device 36 may specify data in the bitstream 31 defining the plurality of matrices and/or the order of the plurality of matrices such that the index may uniquely identify a particular one of the plurality of matrices.

In some instances, the signal value includes two or more bits that define an index associated with one of a plurality of rendering algorithms used to render spherical harmonic coefficients to a plurality of speaker feeds. Again, both the bitstream generation device 36 and the extraction device 38 may be configured with information indicating the plurality of rendering algorithms and the order of the plurality of rendering algorithms such that the index may uniquely identify a particular one of the plurality of matrices. Alternatively, the bitstream generation device 36 may specify data in the bitstream 31 defining the plurality of matrices and/or the order of the plurality of matrices such that the index may uniquely identify a particular one of the plurality of matrices.

In some instances, the bitstream generation device 36 specifies audio rendering information 39 on a per audio frame basis in the bitstream. In other instances, bitstream generation device 36 specifies the audio rendering information 39 a single time in the bitstream.

The extraction device 38 may then determine audio rendering information 39 specified in the bitstream. Based on the signal value included in the audio rendering information 39, the audio playback system 32 may render a plurality of speaker feeds 35 based on the audio rendering information 39. As noted above, the signal value may in some instances include a matrix used to render spherical harmonic coefficients to a plurality of speaker feeds. In this case, the audio playback system 32 may configure one of the audio renderers 34 with the matrix, using this one of the audio renderers 34 to render the speaker feeds 35 based on the matrix.

In some instances, the signal value includes two or more bits that define an index that indicates that the bitstream includes a matrix used to render the spherical harmonic coefficients 27' to the speaker feeds 35. The extraction device 38 may parse the matrix from the bitstream in response to the index, whereupon the audio playback system 32 may configure one of the audio renderers 34 with the parsed matrix and invoke this one of the renderers 34 to render the speaker feeds 35. When the signal value includes two or more bits that define a number of rows of the matrix included in the bitstream and two or more bits that define a number of columns of the matrix included in the bitstream, the extraction device 38 may parse the matrix from the bitstream in response to the index and based on the two or more bits that define a number of rows and the two or more bits that define the number of columns in the manner described above.

In some instances, the signal value specifies a rendering algorithm used to render the spherical harmonic coefficients 27' to the speaker feeds 35. In these instances, some or all of the audio renderers 34 may perform these rendering algorithms. The audio playback device 32 may then utilize the specified rendering algorithm, e.g., one of the audio renderers 34, to render the speaker feeds 35 from the spherical harmonic coefficients 27'.

When the signal value includes two or more bits that define an index associated with one of a plurality of matrices used to render the spherical harmonic coefficients 27' to the speaker feeds 35, some or all of the audio renderers 34 may represent this plurality of matrices. Thus, the audio playback system 32 may render the speaker feeds 35 from the spherical harmonic coefficients 27' using the one of the audio renderers 34 associated with the index.

When the signal value includes two or more bits that define an index associated with one of a plurality of rendering algorithms used to render the spherical harmonic coefficients 27' to the speaker feeds 35, some or all of the audio renderers 34 may represent these rendering algorithms. Thus, the audio playback system 32 may render the speaker feeds 35 from the spherical harmonic coefficients 27' using one of the audio renderers 34 associated with the index.

Depending on the frequency with which this audio rendering information is specified in the bitstream, the extraction device 38 may determine the audio rendering information 39 on a per audio frame basis or a single time.

By specifying the audio rendering information 39 in this manner, the techniques may potentially result in better reproduction of the multi-channel audio content 35 and according to the manner in which the content creator 22 intended the multi-channel audio content 35 to be reproduced. As a result, the techniques may provide for a more immersive surround sound or multi-channel audio experience.

While described as being signaled (or otherwise specified) in the bitstream, the audio rendering information 39 may be specified as metadata separate from the bitstream or, in other words, as side information separate from the bitstream. The bitstream generation device 36 may generate this audio rendering information 39 separate from the bitstream 31 so as to maintain bitstream compatibility with (and thereby enable successful parsing by) those extraction devices that do not support the techniques described in this disclosure. Accordingly, while described as being specified in the bitstream, the techniques may allow for other ways by which to specify the audio rendering information 39 separate from the bitstream 31.

Moreover, while described as being signaled or otherwise specified in the bitstream 31 or in metadata or side information separate from the bitstream 31, the techniques may enable the bitstream generation device 36 to specify a portion of the audio rendering information 39 in the bitstream 31 and a portion of the audio rendering information 39 as metadata separate from the bitstream 31. For example, the bitstream generation device 36 may specify the index identifying the matrix in the bitstream 31, where a table specifying a plurality of matrixes that includes the identified matrix may be specified as metadata separate from the bitstream. The audio playback system 32 may then determine the audio rendering information 39 from the bitstream 31 in the form of the index and from the metadata specified separately from the bitstream 31. The audio playback system 32 may, in some instances, be configured to download or otherwise retrieve the table and any other metadata from a pre-configured or configured server (most likely hosted by the manufacturer of the audio playback system 32 or a standards body).

In other words and as noted above, Higher-Order Ambisonics (HOA) may represent a way by which to describe directional information of a sound-field based on a spatial Fourier transform. Typically, the higher the Ambisonics order N, the higher the spatial resolution, the larger the number of spherical harmonics (SH) coefficients (N+1)^2, and the larger the required bandwidth for transmitting and storing the data.

A potential advantage of this description is the possibility to reproduce this soundfield on most any loudspeaker setup (e.g., 5.1, 7.1 22.2, . . . ). The conversion from the soundfield description into M loudspeaker signals may be done via a static rendering matrix with $(N+1)^2$ inputs and M outputs. Consequently, every loudspeaker setup may require a dedicated rendering matrix. Several algorithms may exist for computing the rendering matrix for a desired loudspeaker setup, which may be optimized for certain objective or subjective measures, such as the Gerzon criteria. For irregular loudspeaker setups, algorithms may become complex due to iterative numerical optimization procedures, such as convex optimization. To compute a rendering matrix for irregular loudspeaker layouts without waiting time, it may be beneficial to have sufficient computation resources available. Irregular loudspeaker setups may be common in domestic living room environments due to architectural constrains and aesthetic preferences. Therefore, for the best soundfield reproduction, a rendering matrix optimized for such scenario may be preferred in that it may enable reproduction of the soundfield more accurately.

Because an audio decoder usually does not require much computational resources, the device may not be able to compute an irregular rendering matrix in a consumer-friendly time. Various aspects of the techniques described in this disclosure may provide for the use a cloud-based computing approach as follows:

1. The audio decoder may send via an Internet connection the loudspeaker coordinates (and, in some instances, also SPL measurements obtained with a calibration microphone) to a server.
2. The cloud-based server may compute the rendering matrix (and possibly a few different versions, so that the customer may later choose from these different versions).
3. The server may then send the rendering matrix (or the different versions) back to the audio decoder via the Internet connection.

This approach may allow the manufacturer to keep manufacturing costs of an audio decoder low (because a powerful processor may not be needed to compute these irregular rendering matrices), while also facilitating a more optimal audio reproduction in comparison to rendering matrices usually designed for regular speaker configurations or geometries. The algorithm for computing the rendering matrix may also be optimized after an audio decoder has shipped, potentially reducing the costs for hardware revisions or even recalls. The techniques may also, in some instances, gather a lot of information about different loudspeaker setups of consumer products which may be beneficial for future product developments.

Figure 5:
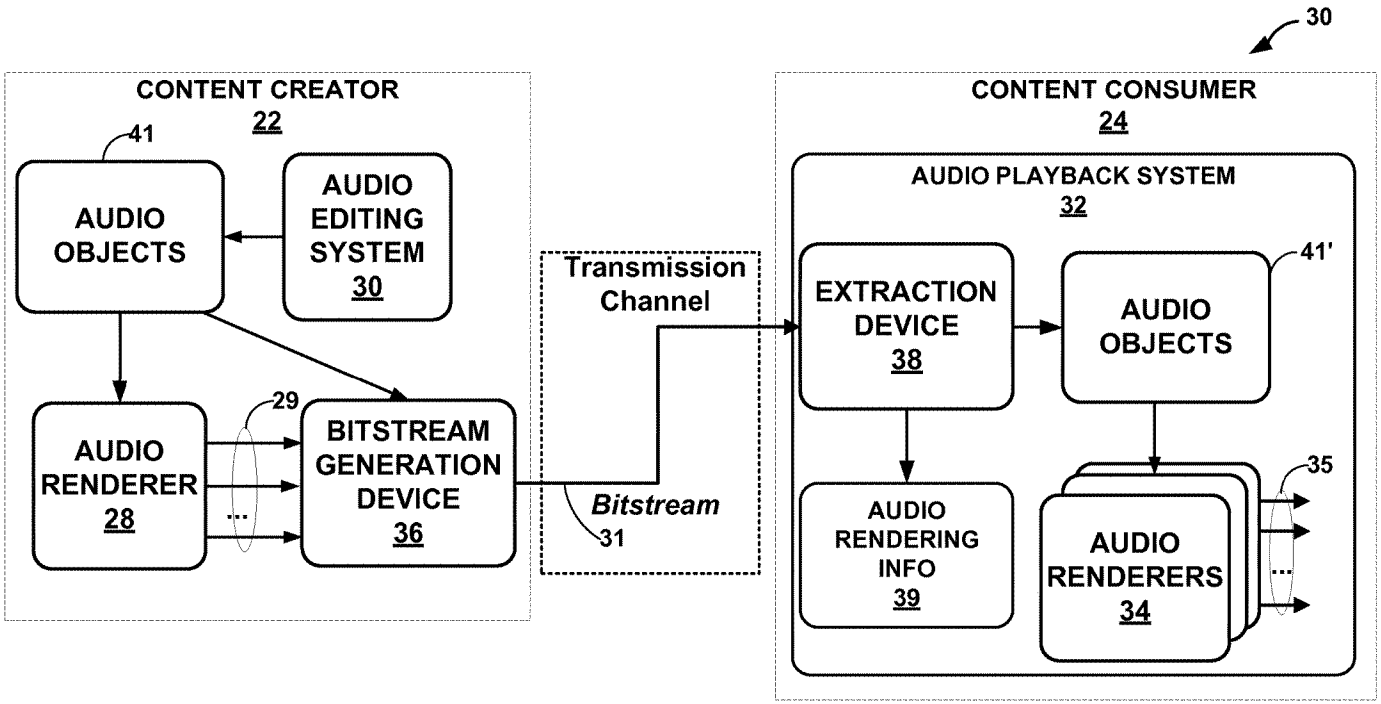
FIG. 5 is a diagram illustrating a system that may implement various aspects of the techniques described in this disclosure.

FIG. 5 is a block diagram illustrating another system 30 that may perform other aspects of the techniques described in this disclosure. While shown as a separate system from system 20, both system 20 and system 30 may be integrated within or otherwise performed by a single system. In the example of FIG. 4 described above, the techniques were described in the context of spherical harmonic coefficients. However, the techniques may likewise be performed with respect to any representation of a sound field, including representations that capture the sound field as one or more audio objects. An example of audio objects may include pulse-code modulation (PCM) audio objects. Thus, system 30 represents a similar system to system 20, except that the techniques may be performed with respect to audio objects 41 and 41' instead of spherical harmonic coefficients 27 and 27'.

In this context, audio rendering information 39 may, in some instances, specify a rendering algorithm, i.e., the one employed by audio renderer 29 in the example of FIG. 5, used to render audio objects 41 to speaker feeds 29. In other instances, audio rendering information 39 includes two or more bits that define an index associated with one of a plurality of rendering algorithms, i.e., the one associated with audio renderer 28 in the example of FIG. 5, used to render audio objects 41 to speaker feeds 29.

When audio rendering information 39 specifies a rendering algorithm used to render audio objects 39' to the plurality of speaker feeds, some or all of audio renderers 34 may represent or otherwise perform different rendering algorithms. Audio playback system 32 may then render speaker feeds 35 from audio objects 39' using the one of audio renderers 34.

In instances where audio rendering information 39 includes two or more bits that define an index associated with one of a plurality of rendering algorithms used to render audio objects 39 to speaker feeds 35, some or all of audio renderers 34 may represent or otherwise perform different rendering algorithms. Audio playback system 32 may then render speaker feeds 35 from audio objects 39' using the one of audio renderers 34 associated with the index.

While described above as comprising two-dimensional matrices, the techniques may be implemented with respect to matrices of any dimension. In some instances, the matrices may only have real coefficients. In other instances, the matrices may include complex coefficients, where the imaginary components may represent or introduce an additional dimension. Matrices with complex coefficients may be referred to as filters in some contexts.

The following is one way to summarize the foregoing techniques. With object or Higher-order Ambisonics (HoA)-based 3D/2D soundfield reconstruction, there may be a renderer involved. There may be two uses for the renderer. The first use may be to take into account the local conditions (such as the number and geometry of loudspeakers) to optimize the soundfield reconstruction in the local acoustic landscape. The second use may be to provide it to the sound-artist, at the time of the content-creation, e.g., such that he/she may provide the artistic intent of the content. One potential problem being addressed is to transmit, along with the audio content, information on which renderer was used to create the content.

The techniques described in this disclosure may provide for one or more of: (i) transmission of the renderer (in a typical HoA embodiment—this is a matrix of size N×M, where N is the number of loudspeakers and M is the number of HoA coefficients) or (ii) transmission of an index to a table of renderers that is universally known.

Again, while described as being signaled (or otherwise specified) in the bitstream, the audio rendering information 39 may be specified as metadata separate from the bitstream or, in other words, as side information separate from the bitstream. The bitstream generation device 36 may generate this audio rendering information 39 separate from the bitstream 31 so as to maintain bitstream compatibility with (and thereby enable successful parsing by) those extraction devices that do not support the techniques described in this disclosure. Accordingly, while described as being specified in the bitstream, the techniques may allow for other ways by which to specify the audio rendering information 39 separate from the bitstream 31.

Moreover, while described as being signaled or otherwise specified in the bitstream 31 or in metadata or side information separate from the bitstream 31, the techniques may enable the bitstream generation device 36 to specify a portion of the audio rendering information 39 in the bitstream 31 and a portion of the audio rendering information 39 as metadata separate from the bitstream 31. For example, the bitstream generation device 36 may specify the index identifying the matrix in the bitstream 31, where a table specifying a plurality of matrixes that includes the identified matrix may be specified as metadata separate from the bitstream. The audio playback system 32 may then determine the audio rendering information 39 from the bitstream 31 in the form of the index and from the metadata specified separately from the bitstream 31. The audio playback system 32 may, in some instances, be configured to download or otherwise retrieve the table and any other metadata from a pre-configured or configured server (most likely hosted by the manufacturer of the audio playback system 32 or a standards body).

Figure 6:
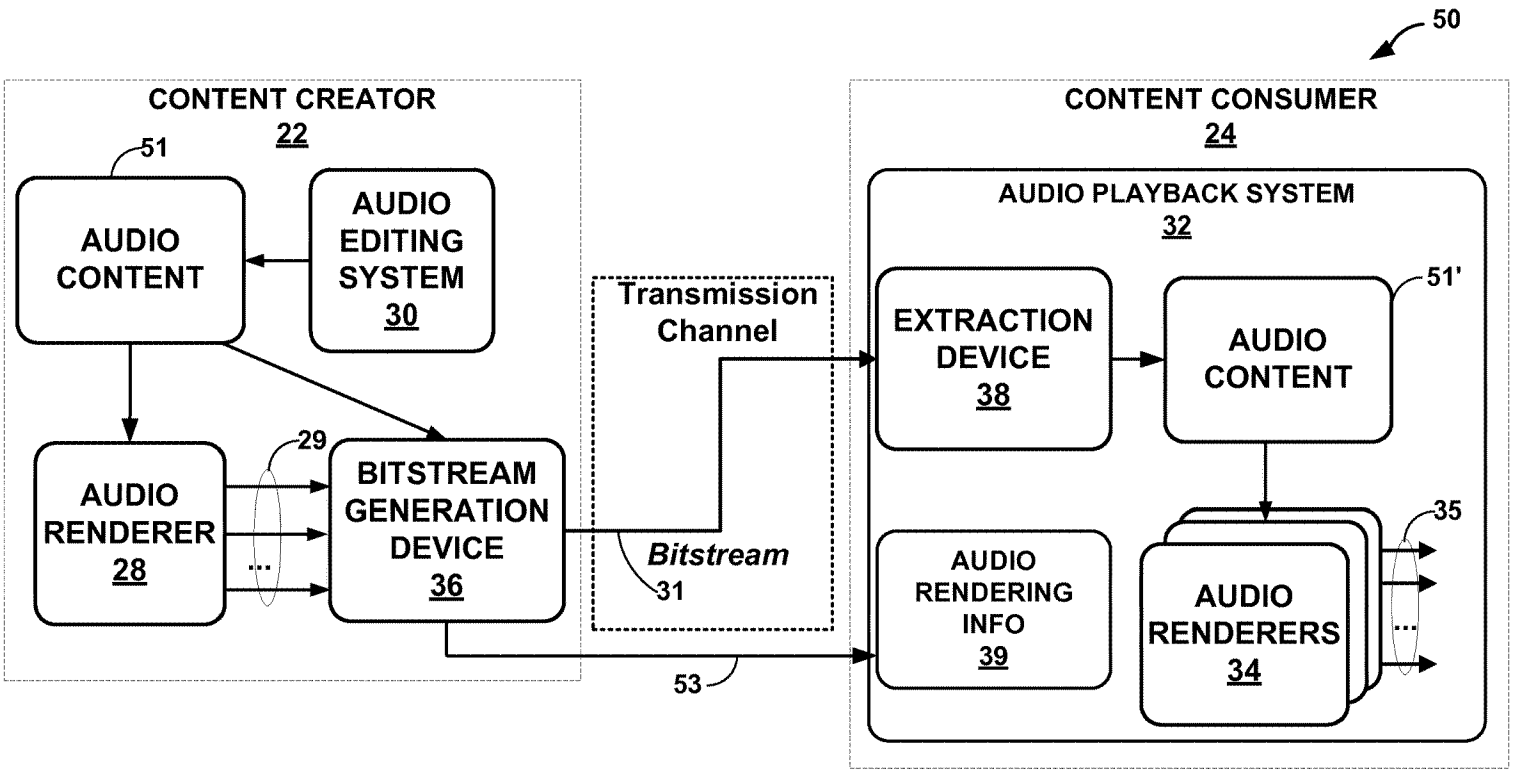
FIG. 6 is a block diagram illustrating another system 50 that may perform various aspects of the techniques described in this disclosure.

FIG. 6 is a block diagram illustrating another system 50 that may perform various aspects of the techniques described in this disclosure. While shown as a separate system from the system 20 and the system 30, various aspects of the systems 20, 30 and 50 may be integrated within or otherwise performed by a single system. The system 50 may be similar to systems 20 and 30 except that the system 50 may operate with respect to audio content 51, which may represent one or more of audio objects similar to audio objects 41 and SHC similar to SHC 27. Additionally, the system 50 may not signal the audio rendering information 39 in the bitstream 31 as described above with respect to the examples of FIGS. 4 and 5, but instead signal this audio rendering information 39 as metadata 53 separate from the bitstream 31.

Figure 7:
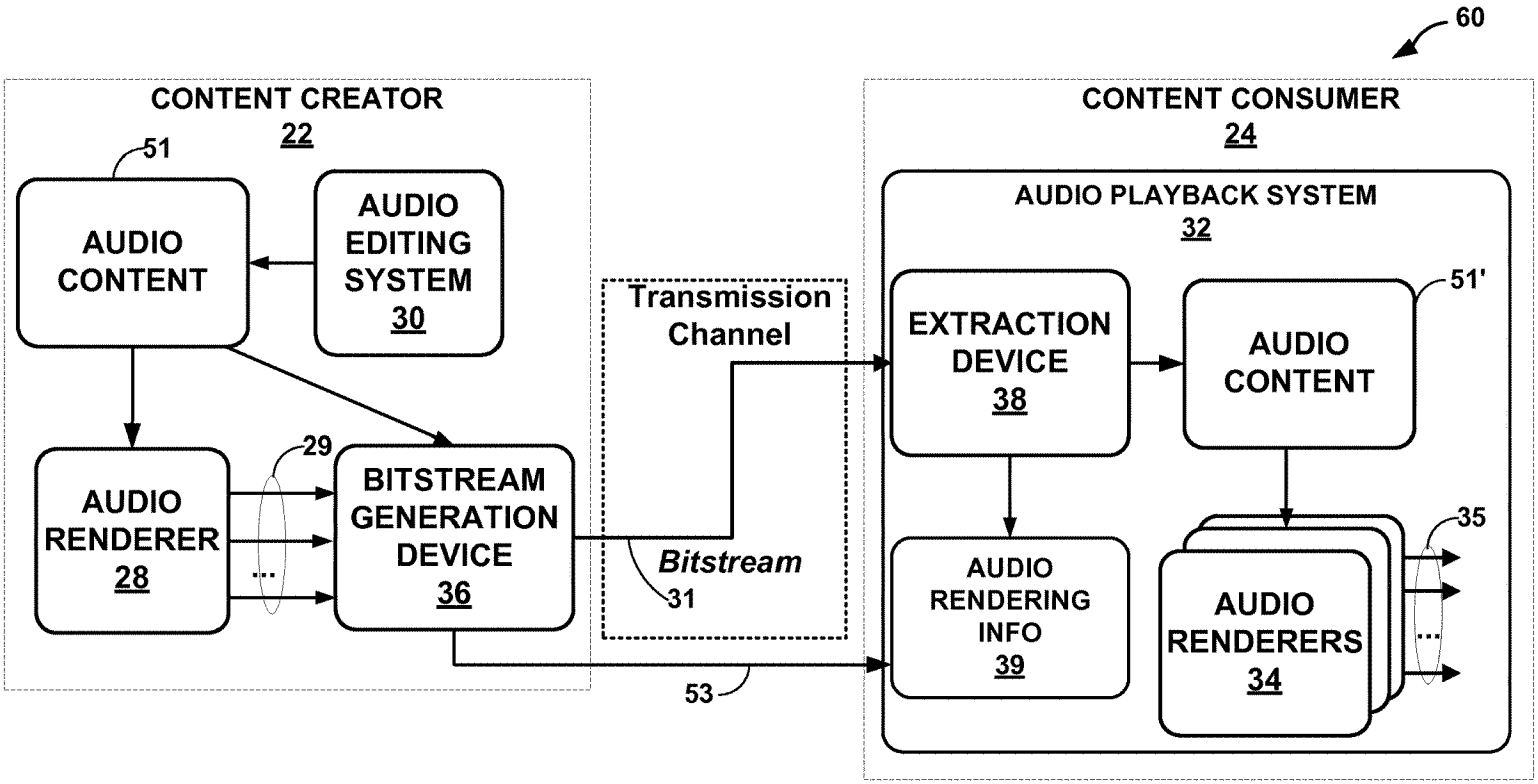
FIG. 7 is a block diagram illustrating another system 60 that may perform various aspects of the techniques described in this disclosure.

FIG. 7 is a block diagram illustrating another system 60 that may perform various aspects of the techniques described in this disclosure. While shown as a separate system from the systems 20, 30 and 50, various aspects of the systems 20, 30, 50 and 60 may be integrated within or otherwise performed by a single system. The system 60 may be similar to system 50 except that the system 60 may signal a portion of the audio rendering information 39 in the bitstream 31 as described above with respect to the examples of FIGS. 4 and 5 and signal a portion of this audio rendering information 39 as metadata 53 separate from the bitstream 31. In some examples, the bitstream generation device 36 may output metadata 53, which may then be uploaded to a server or other device. The audio playback system 32 may then download or otherwise retrieve this metadata 53, which is then used to augment the audio rendering information extracted from the bitstream 31 by the extraction device 38.

FIGS. 8A-8D are diagram illustrating bitstreams 31A-31D formed in accordance with the techniques described in this disclosure. In the example of FIG. 8A, bitstream 31A may represent one example of bitstream 31 shown in FIGS. 4, 5 and 8 above. The bitstream 31A includes audio rendering information 39A that includes one or more bits defining a signal value 54. This signal value 54 may represent any combination of the below described types of information. The bitstream 31A also includes audio content 58, which may represent one example of the audio content 51.

In the example of FIG. 8B, the bitstream 31B may be similar to the bitstream 31A where the signal value 54 comprises an index 54A, one or more bits defining a row size 54B of the signaled matrix, one or more bits defining a column size 54C of the signaled matrix, and matrix coefficients 54D. The index 54A may be defined using two to five bits, while each of row size 54B and column size 54C may be defined using two to sixteen bits.

The extraction device 38 may extract the index 54A and determine whether the index signals that the matrix is included in the bitstream 31B (where certain index values, such as 0000 or 1111, may signal that the matrix is explicitly specified in bitstream 31B). In the example of FIG. 8B, the bitstream 31B includes an index 54A signaling that the matrix is explicitly specified in the bitstream 31B. As a result, the extraction device 38 may extract the row size 54B and the column size 54C. The extraction device 38 may be configured to compute the number of bits to parse that represent matrix coefficients as a function of the row size 54B, the column size 54C and a signaled (not shown in FIG. 8A) or implicit bit size of each matrix coefficient. Using these determined number of bits, the extraction device 38 may extract the matrix coefficients 54D, which the audio playback device 24 may use to configure one of the audio renderers 34 as described above. While shown as signaling the audio rendering information 39B a single time in the bitstream 31B, the audio rendering information 39B may be signaled multiple times in bitstream 31B or at least partially or fully in a separate out-of-band channel (as optional data in some instances).

In the example of FIG. 8C, the bitstream 31C may represent one example of bitstream 31 shown in FIGS. 4, 5 and 8 above. The bitstream 31C includes the audio rendering information 39C that includes a signal value 54, which in this example specifies an algorithm index 54E. The bitstream 31C also includes audio content 58. The algorithm index 54E may be defined using two to five bits, as noted above, where this algorithm index 54E may identify a rendering algorithm to be used when rendering the audio content 58.

The extraction device 38 may extract the algorithm index 50E and determine whether the algorithm index 54E signals that the matrix are included in the bitstream 31C (where certain index values, such as 0000 or 1111, may signal that the matrix is explicitly specified in bitstream 31C). In the example of FIG. 8C, the bitstream 31C includes the algorithm index 54E signaling that the matrix is not explicitly specified in bitstream 31C. As a result, the extraction device 38 forwards the algorithm index 54E to audio playback device, which selects the corresponding one (if available) the rendering algorithms (which are denoted as renders 34 in the example of FIGS. 4-8). While shown as signaling audio rendering information 39C a single time in the bitstream 31C, in the example of FIG. 8C, audio rendering information 39C may be signaled multiple times in the bitstream 31C or at least partially or fully in a separate out-of-band channel (as optional data in some instances).

In the example of FIG. 8D, the bitstream 31C may represent one example of bitstream 31 shown in FIGS. 4, 5 and 8 above. The bitstream 31D includes the audio rendering information 39D that includes a signal value 54, which in this example specifies a matrix index 54F. The bitstream 31D also includes audio content 58. The matrix index 54F may be defined using two to five bits, as noted above, where this matrix index 54F may identify a rendering algorithm to be used when rendering the audio content 58.

The extraction device 38 may extract the matrix index 50F and determine whether the matrix index 54F signals that the matrix are included in the bitstream 31D (where certain index values, such as 0000 or 1111, may signal that the matrix is explicitly specified in bitstream 31C). In the example of FIG. 8D, the bitstream 31D includes the matrix index 54F signaling that the matrix is not explicitly specified in bitstream 31D. As a result, the extraction device 38 forwards the matrix index 54F to audio playback device, which selects the corresponding one (if available) the renderers 34. While shown as signaling audio rendering information 39D a single time in the bitstream 31D, in the example of FIG. 8D, audio rendering information 39D may be signaled multiple times in the bitstream 31D or at least partially or fully in a separate out-of-band channel (as optional data in some instances).

Figure 9:
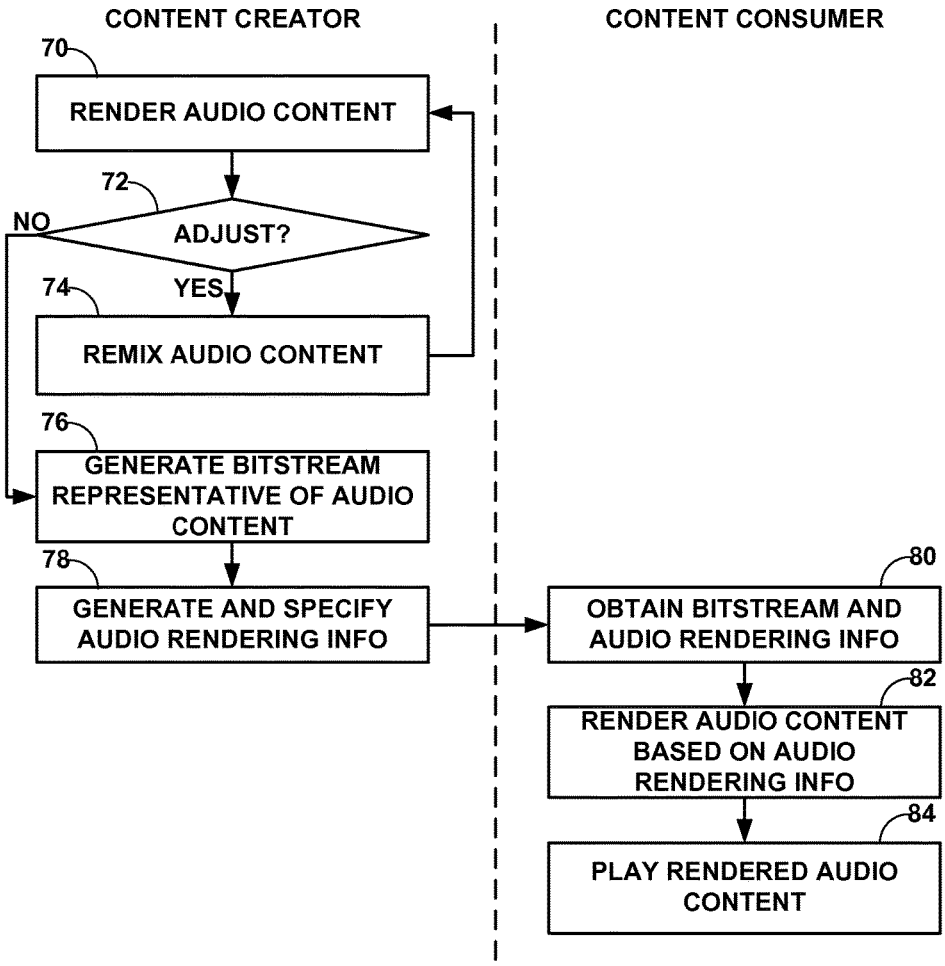
FIG. 9 is a flowchart illustrating example operation of a system, such as one of systems 20, 30, 50 and 60 shown in the examples of FIGS. 4-8D, in performing various aspects of the techniques described in this disclosure.

FIG. 9 is a flowchart illustrating example operation of a system, such as one of systems 20, 30, 50 and 60 shown in the examples of FIGS. 4-8D, in performing various aspects of the techniques described in this disclosure. Although described below with respect to system 20, the techniques discussed with respect to FIG. 9 may also be implemented by any one of system 30, 50 and 60.

As discussed above, the content creator 22 may employ audio editing system 30 to create or edit captured or generated audio content (which is shown as the SHC 27 in the example of FIG. 4). The content creator 22 may then render the SHC 27 using the audio renderer 28 to generated multi-channel speaker feeds 29, as discussed in more detail above (70). The content creator 22 may then play these speaker feeds 29 using an audio playback system and determine whether further adjustments or editing is required to capture, as one example, the desired artistic intent (72). When further adjustments are desired ("YES" 72), the content creator 22 may remix the SHC 27 (74), render the SHC 27 (70), and determine whether further adjustments are necessary (72). When further adjustments are not desired ("NO" 72), the bitstream generation device 36 may generate the bitstream 31 representative of the audio content (76). The bitstream generation device 36 may also generate and specify the audio rendering information 39 in the bitstream 31, as described in more detail above (78).

The content consumer 24 may then obtain the bitstream 31 and the audio rendering information 39 (80). As one example, the extraction device 38 may then extract the audio content (which is shown as the SHC 27' in the example of FIG. 4) and the audio rendering information 39 from the bitstream 31. The audio playback device 32 may then render the SHC 27' based on the audio rendering information 39 in the manner described above (82) and play the rendered audio content (84).

The techniques described in this disclosure may therefore enable, as a first example, a device that generates a bitstream representative of multi-channel audio content to specify audio rendering information. The device may, in this first example, include means for specifying audio rendering information that includes a signal value identifying an audio renderer used when generating the multi-channel audio content.

The device of first example, wherein the signal value includes a matrix used to render spherical harmonic coefficients to a plurality of speaker feeds.

In a second example, the device of first example, wherein the signal value includes two or more bits that define an index that indicates that the bitstream includes a matrix used to render spherical harmonic coefficients to a plurality of speaker feeds.

The device of second example, wherein the audio rendering information further includes two or more bits that define a number of rows of the matrix included in the bitstream and two or more bits that define a number of columns of the matrix included in the bitstream.

The device of first example, wherein the signal value specifies a rendering algorithm used to render audio objects to a plurality of speaker feeds.

The device of first example, wherein the signal value specifies a rendering algorithm used to render spherical harmonic coefficients to a plurality of speaker feeds.

The device of first example, wherein the signal value includes two or more bits that define an index associated with one of a plurality of matrices used to render spherical harmonic coefficients to a plurality of speaker feeds.

The device of first example, wherein the signal value includes two or more bits that define an index associated with one of a plurality of rendering algorithms used to render audio objects to a plurality of speaker feeds.

The device of first example, wherein the signal value includes two or more bits that define an index associated with one of a plurality of rendering algorithms used to render spherical harmonic coefficients to a plurality of speaker feeds.

The device of first example, wherein the means for specifying the audio rendering information comprises means for specify the audio rendering information on a per audio frame basis in the bitstream.

The device of first example, wherein the means for specifying the audio rendering information comprise means for specifying the audio rendering information a single time in the bitstream.

In a third example, a non-transitory computer-readable storage medium having stored thereon instructions that, when executed, cause one or more processors to specify audio rendering information in the bitstream, wherein the audio rendering information identifies an audio renderer used when generating the multi-channel audio content.

In a fourth example, a device for rendering multi-channel audio content from a bitstream, the device comprising means for determining audio rendering information that includes a signal value identifying an audio renderer used when generating the multi-channel audio content, and means for rendering a plurality of speaker feeds based on the audio rendering information specified in the bitstream.

The device of the fourth example, wherein the signal value includes a matrix used to render spherical harmonic coefficients to a plurality of speaker feeds, and wherein the means for rendering the plurality of speaker feeds comprises means for rendering the plurality of speaker feeds based on the matrix.

In a fifth example, the device of the fourth example, wherein the signal value includes two or more bits that define an index that indicates that the bitstream includes a matrix used to render spherical harmonic coefficients to a plurality of speaker feeds, wherein the device further comprising means for parsing the matrix from the bitstream in response to the index, and wherein the means for rendering the plurality of speaker feeds comprises means for rendering the plurality of speaker feeds based on the parsed matrix.

The device of the fifth example, wherein the signal value further includes two or more bits that define a number of rows of the matrix included in the bitstream and two or more bits that define a number of columns of the matrix included in the bitstream, and wherein the means for parsing the matrix from the bitstream comprises means for parsing the matrix from the bitstream in response to the index and based on the two or more bits that define a number of rows and the two or more bits that define the number of columns.

The device of the fourth example, wherein the signal value specifies a rendering algorithm used to render audio objects to the plurality of speaker feeds, and wherein the means for rendering the plurality of speaker feeds comprises means for rendering the plurality of speaker feeds from the audio objects using the specified rendering algorithm.

The device of the fourth example, wherein the signal value specifies a rendering algorithm used to render spherical harmonic coefficients to the plurality of speaker feeds, and wherein the means for rendering the plurality of speaker feeds comprises means for rendering the plurality of speaker feeds from the spherical harmonic coefficients using the specified rendering algorithm.

The device of the fourth example, wherein the signal value includes two or more bits that define an index associated with one of a plurality of matrices used to render spherical harmonic coefficients to the plurality of speaker feeds, and wherein the means for rendering the plurality of speaker feeds comprises means for rendering the plurality of speaker feeds from the spherical harmonic coefficients using the one of the plurality of matrixes associated with the index.

The device of the fourth example, wherein the signal value includes two or more bits that define an index associated with one of a plurality of rendering algorithms used to render audio objects to the plurality of speaker feeds, and wherein the means for rendering the plurality of speaker feeds comprises means for rendering the plurality of speaker feeds from the audio objects using the one of the plurality of rendering algorithms associated with the index.

The device of the fourth example, wherein the signal value includes two or more bits that define an index associated with one of a plurality of rendering algorithms used to render spherical harmonic coefficients to a plurality of speaker feeds, and wherein the means for rendering the plurality of speaker feeds comprises means for rendering the plurality of speaker feeds from the spherical harmonic coefficients using the one of the plurality of rendering algorithms associated with the index.

The device of the fourth example, wherein the means for determining the audio rendering information includes means for determining the audio rendering information on a per audio frame basis from the bitstream.

The device of the fourth example, wherein the means for determining the audio rendering information means for includes determining the audio rendering information a single time from the bitstream.

In a sixth example, a non-transitory computer-readable storage medium having stored thereon instructions that, when executed, cause one or more processors to determine audio rendering information that includes a signal value identifying an audio renderer used when generating the multi-channel audio content; and render a plurality of speaker feeds based on the audio rendering information specified in the bitstream.

It should be understood that, depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially. In addition, while certain aspects of this disclosure are described as being performed by a single device, module or unit for purposes of clarity, it should be understood that the techniques of this disclosure may be performed by a combination of devices, units or modules.

In one or more examples, the functions described may be implemented in hardware or a combination of hardware and software (which may include firmware). If implemented in software, the functions may be stored on or transmitted over as one or more instructions or code on a non-transitory computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol.

In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium.

It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware Various embodiments of the techniques have been described. These and other embodiments are within the scope of the following claims.

What is claimed is:

1. A method of generating a bitstream representative of multi-channel audio content, the method comprising: specifying, in the bitstream and by one or more processors of an audio encoder, audio rendering information that includes a signal value identifying an audio renderer to be used when generating the multi-channel audio content, wherein the signal value includes a plurality of matrix coefficients that define a matrix used to render spherical harmonic coefficients to a plurality of speaker feeds.

2. The method of claim 1, wherein the signal value includes two or more bits that define an index that indicates that the bitstream includes the matrix used to render the spherical harmonic coefficients to the plurality of speaker feeds.

3. The method of claim 2, wherein the signal value further includes two or more bits that define a number of rows of the matrix included in the bitstream and two or more bits that define a number of columns of the matrix included in the bitstream.

4. The method of claim 1, further comprising specifying a second signal value that specifies a rendering algorithm used to render audio objects or the spherical harmonic coefficients to the plurality of speaker feeds.

5. The method of claim 1, wherein the signal value further includes two or more bits that define an index associated with the matrix of a plurality of matrices used to render audio objects or the spherical harmonic coefficients to the plurality of speaker feeds.

6. The method of claim 1, further comprising specifying a second signal value that includes two or more bits that define an index associated with one of a plurality of rendering algorithms used to render the spherical harmonic coefficients to the plurality of speaker feeds.

7. The method of claim 1, wherein specifying the audio rendering information includes specifying the audio rendering information on a per audio frame basis in the bitstream, a single time in the bitstream or from metadata separate from the bitstream.

8. A device configured to generate a bitstream representative of multi-channel audio content, the device comprising: an audio encoder including one or more processors configured to specify, in the bitstream, audio rendering information that includes a signal value identifying an audio renderer to be used when generating the multi-channel audio content, wherein the signal value includes a plurality of matrix coefficients that define a matrix used to render spherical harmonic coefficients to a plurality of speaker feeds; and a memory coupled to the one or more processors, and configured to store the audio rendering information.

9. The device of claim 8, wherein the signal value further includes two or more bits that define an index that indicates that the bitstream includes the matrix used to render the spherical harmonic coefficients to the plurality of speaker feeds.

10. The device of claim 9, wherein the signal value further includes two or more bits that define a number of rows of the matrix included in the bitstream and two or more bits that define a number of columns of the matrix included in the bitstream.

11. The device of claim 8, wherein the one or more processors are further configured to specify a second signal value that specifies a rendering algorithm used to render audio objects or the spherical harmonic coefficients to the plurality of speaker feeds.

12. The device of claim 8, wherein the signal value includes two or more bits that define an index associated with the matrix of a plurality of matrices used to render audio objects or the spherical harmonic coefficients to the plurality of speaker feeds.

13. The device of claim 8, wherein the one or more processors are further configured to specify a second signal value that includes two or more bits that define an index associated with one of a plurality of rendering algorithms used to render the spherical harmonic coefficients to the plurality of speaker feeds.

14. A method of rendering multi-channel audio content from a bitstream, the method comprising:

determining, from the bitstream, audio rendering information that includes a signal value identifying an audio renderer to be used when generating the multi-channel audio content, wherein the signal value includes a plurality of matrix coefficients that define a matrix used to render spherical harmonic coefficients to the multi-channel audio content in the form of a plurality of speaker feeds; and rendering, from the spherical harmonic coefficients and based on the audio rendering information, the multi-channel audio content in the form of the plurality of speaker feeds.

15. The method of claim 14, wherein rendering the plurality of speaker feeds comprises rendering the plurality of speaker feeds based on the matrix.

16. The method of claim 14, wherein the signal value includes two or more bits that define an index indicating that the bitstream includes the matrix used to render the spherical harmonic coefficients to the plurality of speaker feeds, and wherein the method further comprises parsing the matrix from the bitstream in response to the index, and wherein rendering the plurality of speaker feeds comprises rendering the plurality of speaker feeds based on the parsed matrix.

17. The method of claim 16, wherein the signal value further includes two or more bits that define a number of rows of the matrix included in the bitstream and two or more bits that define a number of columns of the matrix included in the bitstream, and wherein parsing the matrix from the bitstream comprises parsing the matrix from the bitstream in response to the index and based on the two or more bits that define a number of rows and the two or more bits that define the number of columns.

18. The method of claim 14, further comprising means for specifying a second signal value that specifies a rendering algorithm used to render audio objects or the spherical harmonic coefficients to the plurality of speaker feeds, and wherein rendering the plurality of speaker feeds comprises rendering the plurality of speaker feeds from the audio objects or the spherical harmonic coefficients using the specified rendering algorithm.

19. The method of claim 14, wherein the signal value includes two or more bits that define an index associated with the matrix of a plurality of matrices used to render audio objects or the spherical harmonic coefficients to the plurality of speaker feeds, and wherein rendering the plurality of speaker feeds comprises rendering the plurality of speaker feeds from the audio objects or the spherical harmonic coefficients using the matrix of the plurality of matrixes associated with the index.

20. The method of claim 14, further comprising specifying a second signal value that includes two or more bits that define an index associated with one of a plurality of rendering algorithms used to render spherical harmonic coefficients to a plurality of speaker feeds, and wherein rendering the plurality of speaker feeds comprises rendering the plurality of speaker feeds from the spherical harmonic coefficients using the one of the plurality of rendering algorithms associated with the index.

21. The method of claim 14, wherein determining the audio rendering information includes determining the audio rendering information on a per audio frame basis from the bitstream, a single time form the bitstream or from metadata separate from the bitstream.

22. A device configured to render multi-channel audio content from a bitstream, the device comprising:

one or more processors configured to;

determine, from the bitstream, audio rendering information that includes a signal value identifying an audio renderer to be used when generating the multi-channel audio content, wherein the signal value includes a plurality of matrix coefficients that define a matrix used to render spherical harmonic coefficients to the multi-channel audio content in the form of a plurality of speaker feeds; and render, from the spherical harmonic coefficients and based on the audio rendering information, the multi-channel audio content as the plurality of speaker feeds; and a memory coupled to the one or more processors, and configured to store the plurality of speaker feeds.

23. The device of claim 22, wherein the one or more processors are configured to render the plurality of speaker feeds based on the matrix.

24. The device of claim 22, wherein the signal value includes two or more bits that define an index indicating that the bitstream includes the matrix used to render the spherical harmonic coefficients to the plurality of speaker feeds, wherein the one or more processors are further configured to parse the matrix from the bitstream in response to the index, and wherein the one or more processors are configured to render the plurality of speaker feeds based on the parsed matrix.

25. The device of claim 24, wherein the signal value further includes two or more bits that define a number of rows of the matrix included in the bitstream and two or more bits that define a number of columns of the matrix included in the bitstream, and wherein the one or more processors are configured to parse the matrix from the bitstream in response to the index and based on the two or more bits that define a number of rows and the two or more bits that define the number of columns.

26. The device of claim 22, wherein the one or more processors are further configured to specifying a second signal value that specifies a rendering algorithm used to render audio objects or spherical harmonic coefficients to the plurality of speaker feeds, and wherein the one or more processors are configured to render the plurality of speaker feeds from the audio objects or the spherical harmonic coefficients using the specified rendering algorithm.

27. The device of claim 22, wherein the signal value includes two or more bits that define an index associated with the matrix of a plurality of matrices used to render audio objects or the spherical harmonic coefficients to the plurality of speaker feeds, and wherein the one or more processors are configured to render the plurality of speaker feeds from the audio objects or the spherical harmonic coefficients using the one of the plurality of matrixes associated with the index.

28. The device of claim 22, wherein the one or more processors are further configured to specifying a second signal value that includes two or more bits that define an index associated with one of a plurality of rendering algorithms used to render spherical harmonic coefficients to a plurality of speaker feeds, and wherein the one or more processors are configured to render the plurality of speaker feeds from the spherical harmonic coefficients using the one of the plurality of rendering algorithms associated with the index.

29. The device of claim 8, wherein the plurality of matrix coefficients define the matrix used to render the spherical harmonic coefficients to the plurality of speaker feeds corresponding to speakers arranged in an irregular speaker geometry.

30. The device of claim 22, wherein the plurality of matrix coefficients define the matrix used to render the spherical harmonic coefficients to the plurality of speaker feeds corresponding to speakers arranged in a regular, but non-standardized speaker geometry.

31. The method of claim 1, further comprising capturing, by one or more microphones, audio data representative of the spherical harmonic coefficients.

32. The device of claim 8, further comprising one or more microphones coupled to the one or more processor, and configured to capture audio data representative of the spherical harmonic coefficients.

33. The method of claim 14, further comprising reproducing, by one or more loudspeakers and based on the plurality of speaker feeds, a soundfield represented by the spherical harmonic coefficients.

34. The device of claim 22, further comprising one or more loudspeakers coupled to the one or more processors, and configured to reproduce, based on the plurality of speaker feeds, a soundfield represented by the spherical harmonic coefficients.

* * * * *